US006666059B1

(12) United States Patent
Tsutsumino

(10) Patent No.: US 6,666,059 B1
(45) Date of Patent: Dec. 23, 2003

(54) METHOD AND DEVICE FOR ROTATING AND MACHINING BAR MATERIAL

(75) Inventor: Takeyoshi Tsutsumino, Takarazuka (JP)

(73) Assignee: Taihei Manufacturing Co., Ltd., Osaka (JP)

( * ) Notice: Subject to any disclaimer, the term of this patent is extended or adjusted under 35 U.S.C. 154(b) by 0 days.

(21) Appl. No.: 10/019,758

(22) PCT Filed: Jul. 2, 1999

(86) PCT No.: PCT/JP99/03605

§ 371 (c)(1),
(2), (4) Date: Dec. 27, 2001

(87) PCT Pub. No.: WO01/02111

PCT Pub. Date: Jan. 11, 2001

(51) Int. Cl.[7] ..... B21B 13/20
(52) U.S. Cl. ..... 72/77; 72/88; 72/112
(58) Field of Search ..... 72/77, 78, 88, 72/112, 122, 123, 126

(56) References Cited

U.S. PATENT DOCUMENTS

| | | | | | |
|---|---|---|---|---|---|
| 1,039,707 | A | * | 10/1912 | Denne | 72/77 |
| 3,262,302 | A | * | 7/1966 | Toney, Jr. | 72/77 |
| 3,367,159 | A | * | 2/1968 | Youtz | 72/78 |
| 4,270,375 | A | * | 6/1981 | Jungesjo | 72/88 |
| 5,076,086 | A | * | 12/1991 | Murayama et al. | 72/88 |

* cited by examiner

*Primary Examiner*—Ed Tolan
(74) *Attorney, Agent, or Firm*—Koda & Androlia

(57) ABSTRACT

A method and device for rotating and machining bar material which comprises holding a disc-shaped rotor rotatably around a horizontal axis, providing a pair of rails which are radially opposite to each other and have chord-shaped sliding surfaces in parallel with each other in the vicinity of the peripheral edge of the front end of said rotor, engaging tool holders slidably with each of said pair of rails, fixing a pair of tools securely by said tool holders, feeding a workpiece of bar material toward the center of rotation of the rotor, holding the workpiece securely between the tools, and rotating the rotor to displace the tools in the directions opposite to each other along the rails.

7 Claims, 7 Drawing Sheets

METHOD AND DEVICE FOR ROTATING AND MACHINING BAR MATERIAL

This application is a 35 USC 371 of PCT/JP99/03605, filed Jul. 2, 1999.

TECHNICAL FIELD

The present invention relates to a method and device for rotating and machining bar material.

BACKGROUND ART

Conventional roll threadening by the use of threadening rolls, for example, consists subjecting the face of material to plastic deformation by rolling between the threadening rolls, when the material is held with a chuck or without, synchronously with the rotation of the rolls. The threadening roll has many ring-like crests equally spaced and formed in the same shape on the outer periphery of the column. A train of three rolls is arranged with their respective rotary axes in parallel. While rotating around the axis, the material (wire) is fed between the three rolls for thread cutting. The material is returned, and put out of the die.

In the past, consequently, it was impossible to chase non-rotatable materials by means of the threading rolls, and threads with triangular crests and roots were only producible.

For solution of the abovementioned task, the object of the present invention is to provide a method and device for machining even non-rotatable materials for making threads of different shapes including unevenness.

DISCLOSURE OF THE INVENTION

For solution of said subjects, the construction of this invention is as follows. Namely, a method in the first construction comprises holding a disc-shaped rotor rotatably around a horizontal axis, providing a pair of rails which are radially opposite to each other and have chord-shaped sliding surfaces in parallel with each other in the vicinity of the peripheral edge of the front end of said rotor, engaging tool holders slidably with each of said pair of rails, fixing a pair of tools securely by said tool holders, feeding a workpiece of bar material toward the center of rotation of the rotor and securely holding between the tools, and rotating the rotor to displace the tools in the directions opposite to each other along the rails.

A device in the second construction includes a disc-shaped rotor held rotatably around a horizontal axis, a driving means for said rotor, a pair of rails which are radially opposite to each other and have chord-shaped sliding surfaces in parallel with each other in the vicinity of the peripheral edge of the front end of said rotor, tool holders engaged slidably with each of said pair of rails, and a pair of tools securely fixed by said tool holders. Then, the rotor is rotated, the tools are displaced in the directions opposite to each other along the rails.

A device in the third construction includes a disc-shaped rotor held rotatably around a horizontal axis, a driving means for said rotor, a pair of rails which are radially opposite to each other and have chord-shaped sliding surfaces in parallel with each other in the vicinity of the peripheral edge of the front end of said rotor, tool holders engaged slidably with each of said pair of rails, and a pair of tools securely fixed by said tool holders, a pair of racks securely fixed on the back of said tool holders, a pinion in a meshing relationship with said pair of racks, a pinion shaft having said pinion fixed to the front end thereof and extending backwards through the center of rotation of said rotor with a space between them, and a driving means for said pinion shaft.

Said tools are adapted to be displaced in opposite directions along said rails via said rack and said pinion by making use of the difference of said rotor and pinion in rotary speed.

A device in the forth construction includes a disc-shaped rotor held rotatably around a horizontal axis, a pair of rails which are radially opposite to each other and have chord-shaped sliding surfaces in parallel with each other in the vicinity of the peripheral edge of the front end of said rotor, tool holders engaged slidably with each of said pair of rails, and a pair of tools securely fixed by said tool holders, a pair of racks securely fixed on the back of said tool holders, a pinion in a meshing relationship with said pair of racks, a pinion shaft having said pinion fixed to the front end thereof and extending backwards through the center of rotation of said rotor with a space between them, and a planetary gear connected between said rotor and said pinion shaft.

Said tools are adapted to be displaced in opposite directions along said rails via said rack and said pinion by making use of the difference of said rotor and pinion in rotary speed.

A device in the fifth construction includes a disc-shaped rotor held rotatably around a horizontal axis, a pair of rails which are radially opposite to each other and have chord-shaped sliding surfaces in parallel with each other in the vicinity of the peripheral edge of the front end of said rotor, tool holders engaged slidably with each of said pair of rails, and a pair of tools securely fixed by said tool holders, a pair of racks securely fixed on the back of said tool holders, a pinion in a meshing relationship with said pair of racks, a pinion shaft having said pinion fixed to the front end thereof and extending backwards through the center of rotation of said rotor with a space between them, and a planetary gear connected between said rotor and said pinion shaft.

Said planetary gear includes an input part, an output part, and a differential part.

The input part includes a cylinder member having a horizontal axis and an opening at one end thereof, an input outer gear on the outer periphery of the opening, and an input inner gear on the inner periphery of the opening. The input outer gear is driven by a driving motor and bears meshing relationship with a driven gear secured to the rotor.

In the output part, an elastic cylinder member having an opening at one end thereof is provided. At said opening, an elastic output outer gear is provided and partially meshes with said input inner gear. An output shaft is connected with the other end of the elastic cylinder member, and said output shaft is supported by a bearing concentrically on the other end of said cylinder member of the input part. The output shaft jut forth from the cylinder member and an output driving gear is secured to the jut. And an output driven gear, which is to mesh with the output driving gear, is fixedly connected with said pinion shaft.

In the differential part, a rigid oval plate is fitted within the end portion of said elastic cylinder member of said putout portion, via an elastic bearing on the outer peripheral face. Elastic deformation of the cylinder member into an oval shape may cause said output outer gear to engage partially with said input inner gear. A differential shaft is connected to the center of said oval plate, and a servo differential motor is connected with the leading end of the differential shaft.

Said tools are adapted to be displaced in opposite directions along said rails via said rack and said pinion by making use of the difference of said-rotor and pinion in rotary speed.

A method in the sixth construction includes, in addition to the method of first construction, said tools being thread rolling flat die.

A device in the seventh construction includes, in addition to the device of second, third, forth, fifth or sixth construction, said tools being thread rolling flat die.

In accordance with the present invention, non-rotatable materials can be machined for making threads including, unevenness by simple construction. Also, according to tool, various kinds of threads with triangular crests and roots, unevenness of other kind can be simply machined.

MOST PREFERRED EMBODIMENTS FOR EMBODYING THE INVENTION

Figure 1:
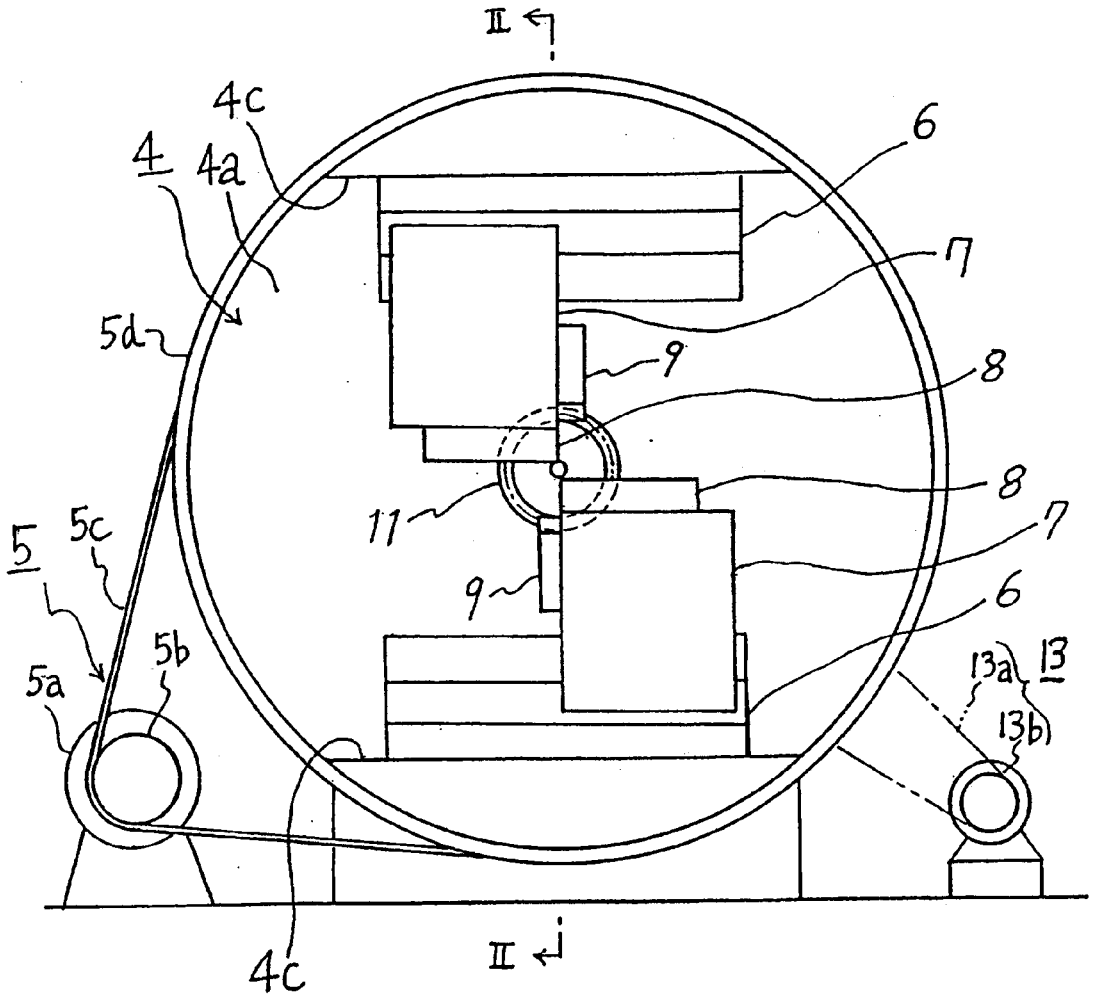
FIG. 1 is a front view of one embodiment of present invention.

The embodiment of the present invention will be described with reference to one example as shown in the drawings.

Figure 2:
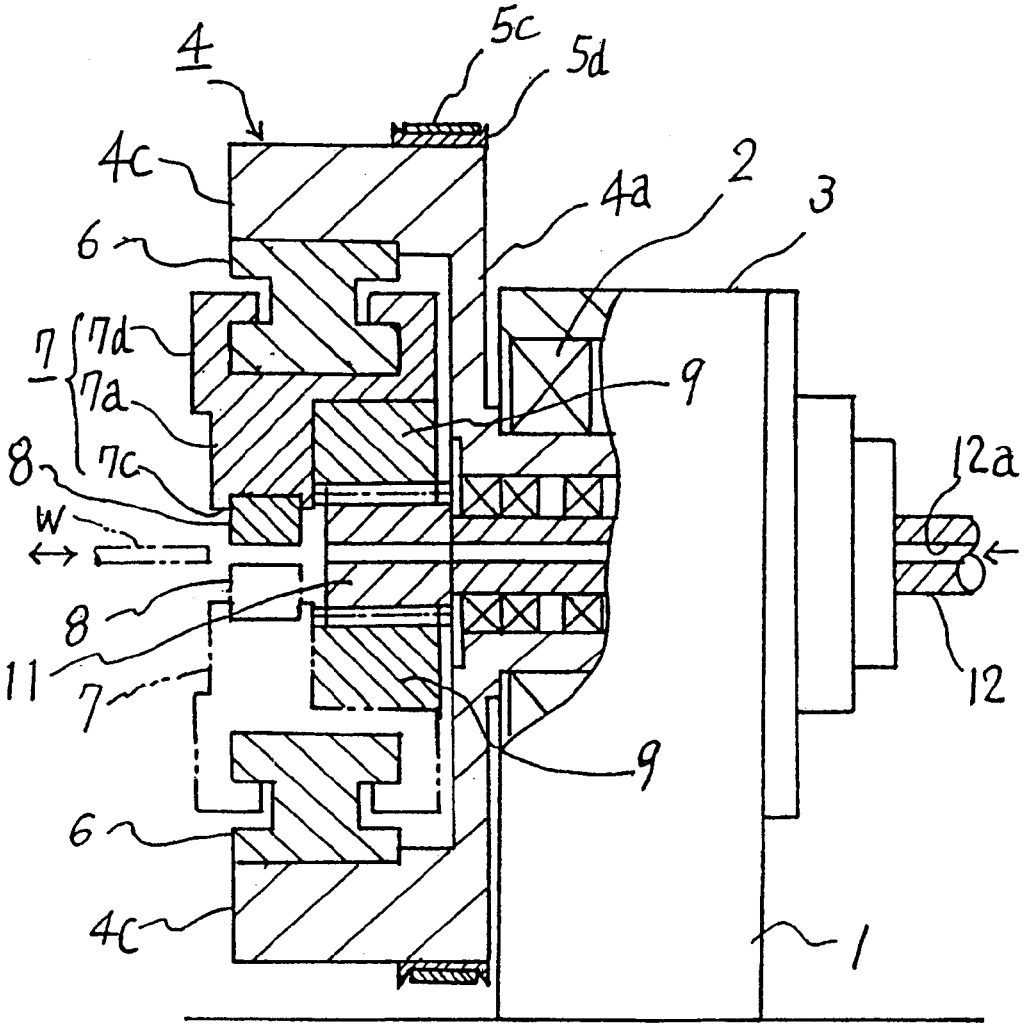
FIG. 2 is a sectional view of II—II line on FIG. 1.

Referring to FIGS. 1 and 2, the device in accordance with the present invention is principally composed of a disc-shaped rotor 4 held rotatably around a horizontal axis, a driving means 5 for said rotor 4, a pair of rails 6 which are radially opposite to each other and have chord-shaped sliding surfaces in parallel with each other in the vicinity of the peripheral edge of the front end of said rotor 4, die holders 7 engaged slidably with each of said pair of rails 6, and a pair of thread rolling flat die 8 securely fixed by said die holders 7.

A pair of racks 9 securely fixed on the backs of said die holders, a pinion 11 in a meshing relationship with said pair of racks 9, a pinion shaft 12 having said pinion 11 fixed to the front end thereof and extending backwards through the center of rotation of said rotor 4 with a space between them, and a driving means 13 for said pinion shaft 12.

Said die holders 7 are adapted to be displaced in opposite directions along said rails 6 via said rack and said pinion by making use of the difference of said rotor 4 and pinion shaft 12 in rotary speed.

Said rotor 4 is rotatably supported by a main bearing 2 in a bearing stand 1. The numeral 3 designates a bearing cap. Said rotor 4 is provided with a disk portion 4*a* formed integral and concentrical with a boss 4*b* carried by said bearing stand 1, and there is provided a crescent-shaped portion 4*c* formed integral with said disk portion 4*a* on the peripheral edge which is opposed radially to said disk portion 4*a*.

Said driving means 5 for rotor has a main motor 5*a* resting at side of the rotor 4, a driving pulley 5*b* provided on the shaft, a driven pulley 5*d* on the outer periphery of the disk portion 4*a*, and a belt 5*c* connecting said both pulleys. AnH-beam rail member 6 is engaged slidably with said crescent-shaped portion 4*c*. The end faces radially opposed to each other with the center of rotation of the rotor 4 interposed therebetween have chord-shaped sliding faces in parallel with each other.

In the die holder 7, the end face of the radial inner side of the rectangular parallelepiped-like body provides a mounting face for die, on which the thread rolling flat die is secured by a bolt 7*c*. The face in opposition to said end face is a sliding guidance 7*d* which is fit onto said rail 6. The rack 9 is fixed by the bolt 7*c* on the rear of the die holder 7. The rack 9 includes the tooth crest having an end face in parallel with the sliding face of said rail 6.

A driven motor 13*b* and a belt transmission 13*a* are provided for a pinion driving means 13. An oil hole 12*a* is provided extending through the pinion shaft 12 concentrically thereof.

The operation of the device will be described. The main motor 5*a* and driven motor 13*b* are put in motion in such a manner that the rotor 4 and pinion shaft 12 may retain rotary speed at the same level. Under this state of things, a workpiece (bar material) of a wire is fed toward the center of rotation, while dies are laid in opposite positions in respect to the center of rotation. Then, the material is securely held between the dies by a portion of corresponding length to that of threads to be cut.

Next, the rotary speed of the driven motor 13*b* is changed by a known rotary speed control such as sequencer, and then the rotary speed of the pinion shaft is changed, the dies are moved toward the center through the engagement of the pinion 11 to the rack 9 under the influence of the difference of the rotor 4 and pinion shaft 12 in rotary speed.

At this moment, while the rotor 4 makes one rotation, the dies make one revolution, too, so as to displace diametrically by a length of the circumference of the material (wire). 5~6 revolutions, for example, will complete the thread cutting. During the operation, oil is supplied from the oil hole 12*a* for the cooling and lubrication purposes. This embodiment is useful for machining of a bar material with a comparatively small diameter and a low rigidity.

Figure 3:
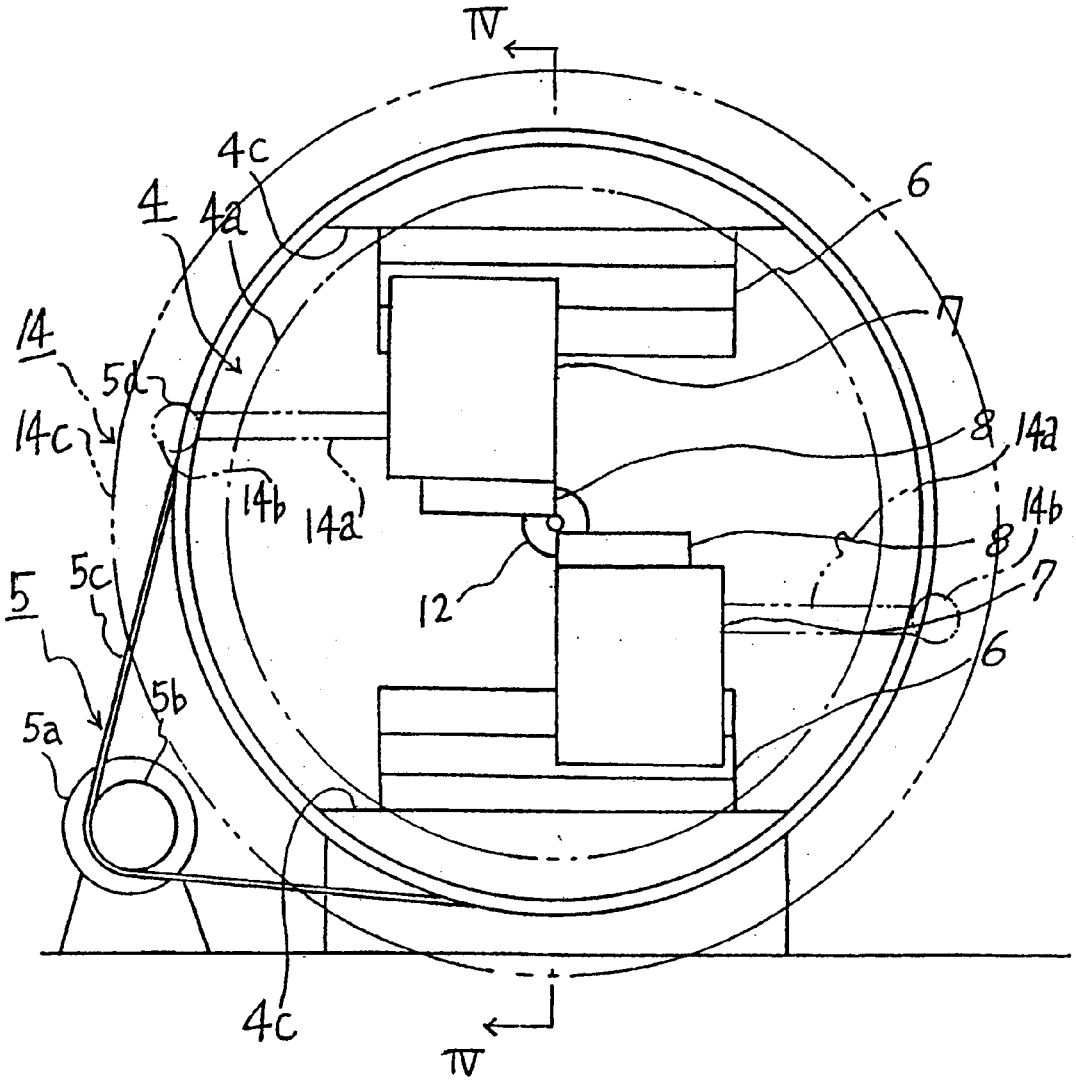
FIG. 3 is a front view of the other embodiment of present invention.
Figure 4:
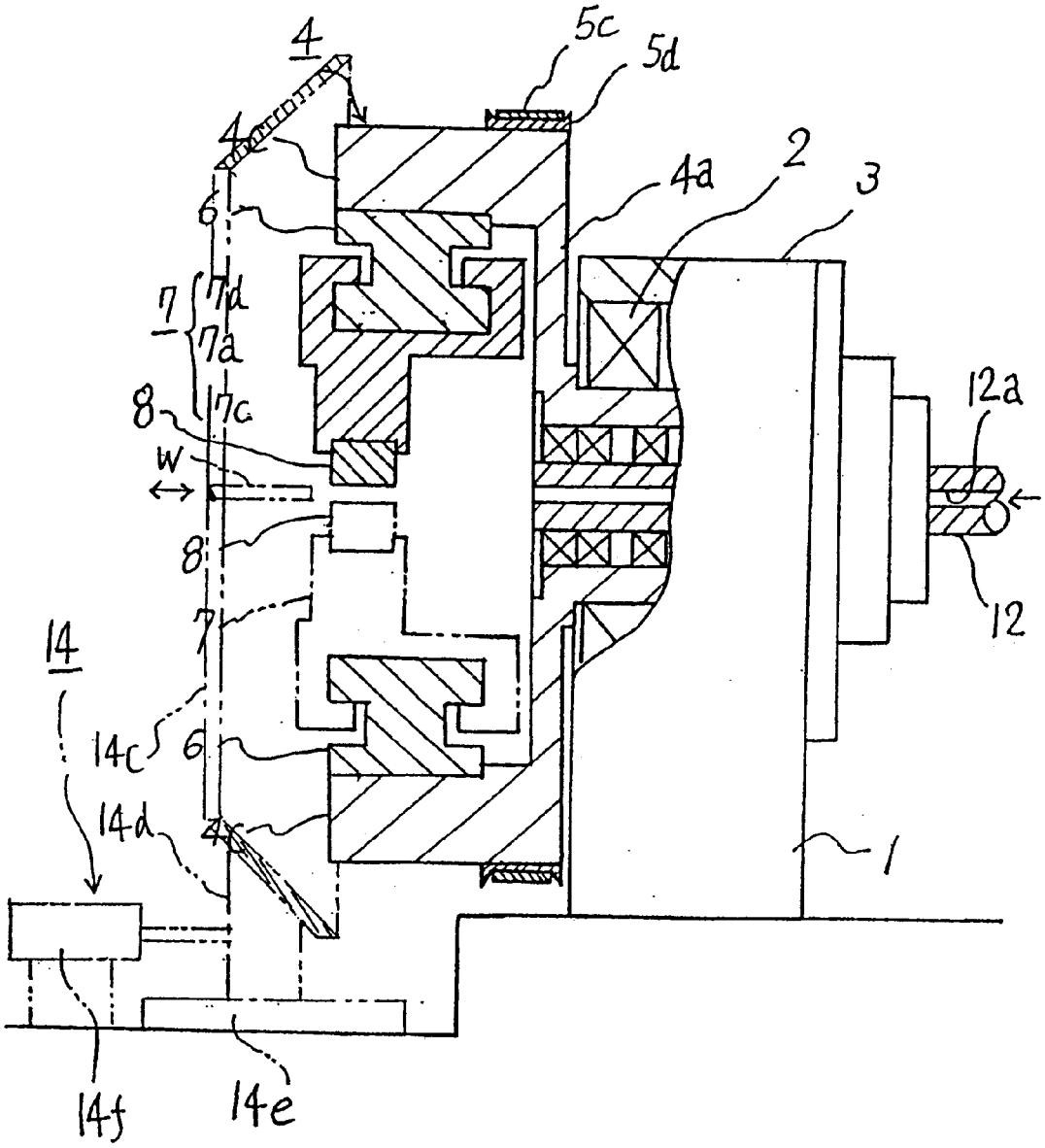
FIG. 4 is a sectional view of III—III line on FIG. 3.

Another embodiment as shown by FIGS. 3 and 4, in which said rack 9, pinion 11, and pinion shaft 12 are missing, that is, provides a disk-shaped rotor 4 held rotatably around the horizontal axis, a driving means 5 for said rotor, a pair of rails 6 having chord-shaped sliding faces in parallel with each other in a radial direction in the vicinity of the peripheral edge of the front end of said rotor, tool holders 7 slidably engaged with the pair of rails, and tools 8 securely fixed by the tool folders and a tool transfer means 14.

When rotating the rotor 4, said tools 8 are designed to be moved along said rails 6 in opposite directions.

In said tool transfer means 14, arms 14*a*, 14*a* are protruding from the end face of the tool holder to one of the directions in which the tool is slidable. Rollers 14*b*, 14*b* are rotatably mounted on the arms around the axis in parallel with the rotary axis of the rotor 4. A guide ring 14*c* is inscribed in said rollers 14*b*, 14*b*, concentric with the rotary axis of the rotor 4, and has tapered inner face that expands toward the end face of the rotor at the tool's side.

A leg portion 14*d* is hanging from the lower face of the guide ring 14*c*. A guide rail 14e serves to slidably guide the leg portion 14*d* in a direction in parallel with the rotary axis of the rotor 4. A reciprocating drive source 14*f* consisting of a fluid piston cylinder is coupled to said leg portion 14*d*.

The operation of said device will be described. With the main motor 5*a* kept in motion to drive the rotor 4 to rotate at a constant speed, while the dies 8 have been separated from each other by the centrifugal force in opposite directions in respect to the center of rotation. A wire as workpiece (bar material) is fed toward the center of rotation (from the left hand to the right hand of FIG. 4), and securely held between the dies by a portion corresponding to a length of threads being cut.

Next, when the tool transfer means 14 is set in motion to drive the reciprocating drive source 14*d*, the guide ring 14*c* displaces toward the rotor 4's side (from left to right of FIG. 4), and the rollers 14*b*, 14*b* which roll touching internally the tapered face of the rotor 4 undergo a force directing radially of the guide ring 14*c*.

The dies 8, 8 revolve along with the rotor 4 until both members come close to each other to such an extent that the dies will hold the bar material therebetween in a radial direction, and then, make 5–6 turns around the bar material before the roll threading is over. This specific embodiment is suitable for machining a bar material of a comparatively large diameter and a high rigidity.

Figure 5:
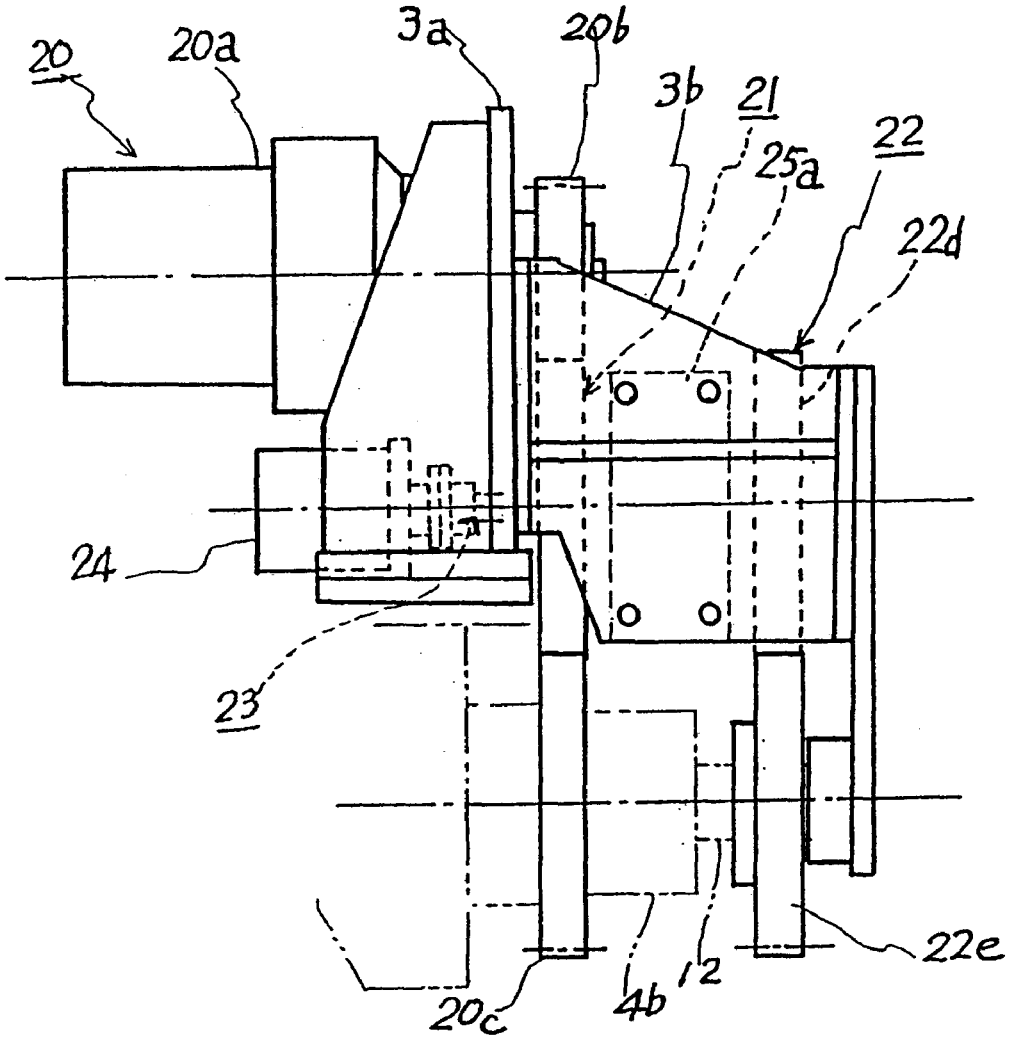
FIG. 5 is a front view of the farther embodiment of present invention.
Figure 6:
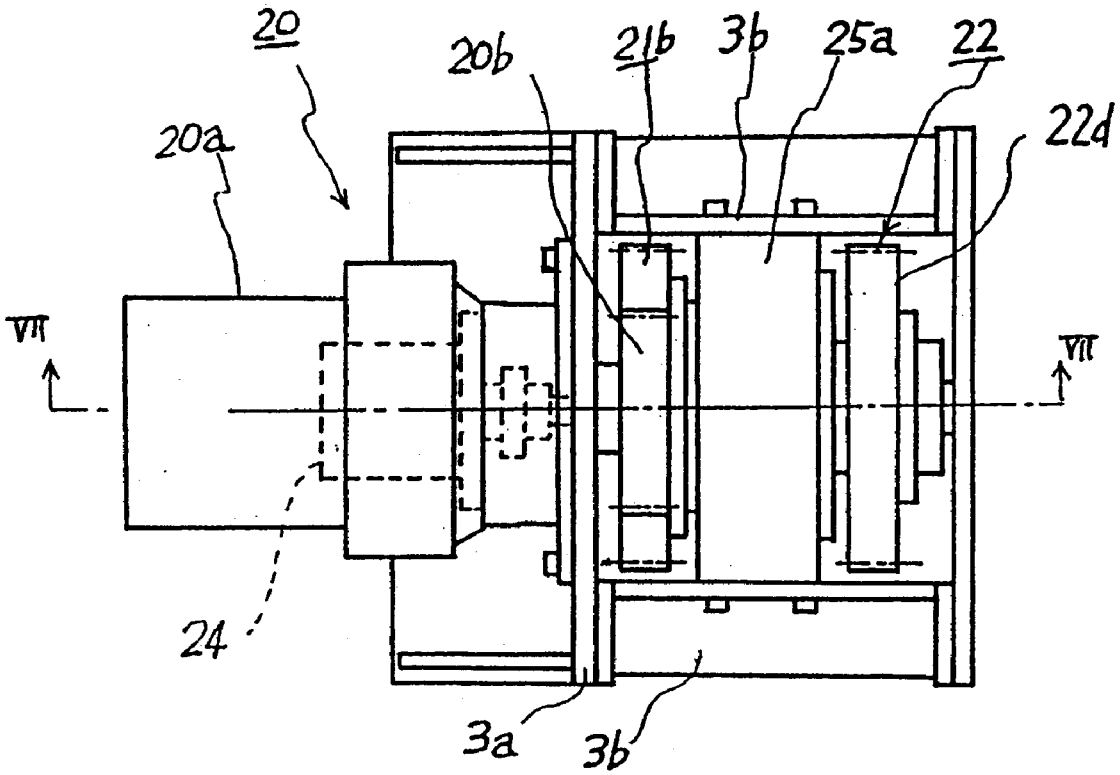
FIG. 6 is a plan view of the farther embodiment of present invention.
Figure 7:
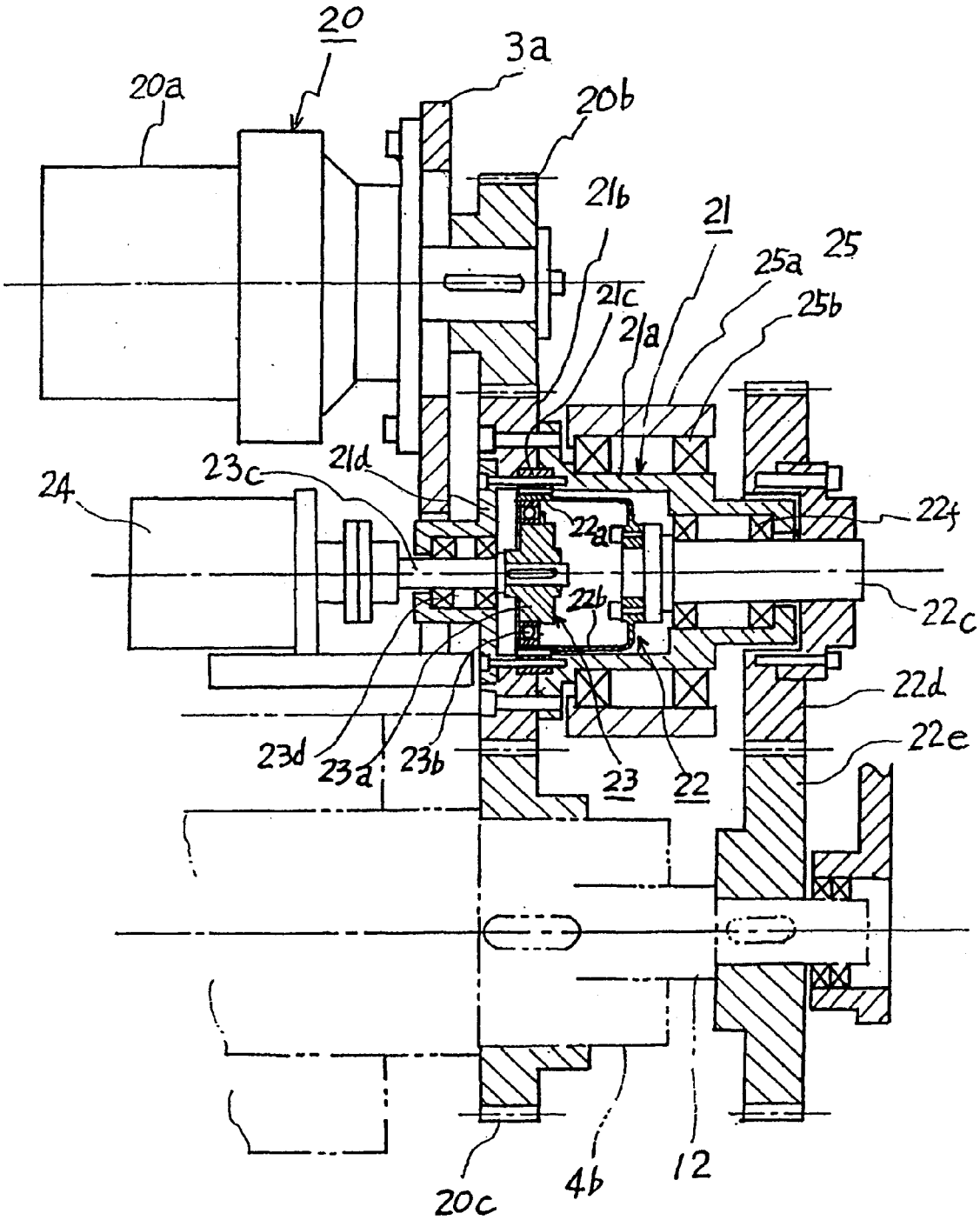
FIG. 7 is an enlarged sectional view of VI—VI line on FIG. 6.

FIGS. 5 to 7 show further embodiment, in which a wave generator differential gear drive 20 is used instead of said rotor driving means 5 and pinion shaft driving means 13. This device 20 principally consists of an input part 21, an output part 22, and a differential part 23.

That is, the body of the device (bearing cap 3) has a stand 3*a* disposed on the upper face thereof and provided with a driving motor 20*a* constituted by a servo motor as a rotor driving means, which is connected with said input part 21 via a driving gear 20*b*.

The input part 21 includes a cylinder member 21*a* having a horizontal axis and an opening at one end thereof, an input outer gear 21*b* on the outer periphery of the opening, and an input inner gear 21*c* on the inner periphery of the opening.

The input outer gear 21*b* bears meshing relationship with a driving gear 20*b* on the upper part thereof and a driven gear 20*c* on the lower part, which driven gear 20*c* being secured concentrically to the boss 4*b* of the rotor.

An input cylinder member 21*a* is supported by a bracket 3*b* projecting out of the stand 3*a* via a bearing 25*b* of a support casing 25*a*. This allows the cylinder member 21*a* to be supportably and rotatably placed in fixed position in respect to the device body. The opening of the input cylinder member 21*a* at the gear side is covered with an end plate 21*d*, through which a differential shaft 23*c* extends, as discussed later.

In the output part 22, an elastic cylinder member 22*b* having an opening at one end thereof is provided. At said opening, an elastic output outer gear 22*a* is provided and partially meshes with said input inner gear 21*c*. An output shaft 22*c* is connected with the other end of the elastic cylinder member 22*b*, and said output shaft 22*c* is supported by a bearing 22f concentrically on the other end of said cylinder member 21*a* of the input part.

The output shaft 22*c* jut forth from the cylinder member 21*a* and an output driving gear 22*d* is secured to the jut. And an output driven gear 22*e*, which is to mesh with the output driving gear 22*d*, is fixedly connected with said pinion shaft 12.

Said cylinder member 22*b* is made of a thin steel plate, its end portion being slightly thick, and formed integral with the outer gear 22*a*. These members are so elastic as a whole that they may be easily formed into an oval shape in the neighborhood of the end portion.

In the differential part 23, a rigid oval plate (wave generator) 23*a* is fitted within the end portion of said elastic cylinder member 22*b* of said output portion, via an elastic ball bearing 23*b* on the outer peripheral face. Elastic deformation of the cylinder member 22*b* into an oval shape may cause said output outer gear 22*a* to engage partially with said input inner gear 21*c* near the outer periphery of the oval.

A differential shaft 23*c* is connected to the center of said oval plate to penetrate said end plate 21*d* via the bearing, and a servo differential motor 24 is connected with the leading end of the differential shaft 23*c*, so that the motor 24 may be fixed to the device body as the driving motor 20*a* so does. The inner and outer rings of said ball bearing 23*b* consist of thin steel ring in a manner to readily deform into an oval shape.

The operation of the device in accordance with this embodiment will be described. The driving motor 20*a* urges the driving gear 20*b* to rotate the driven gear 20*c* in the same direction via the input outer gear 21*b* as an intermediate gear (the gears 21*b* and 20*c* are the same in the number of tooth), thereby rotating the rotor 4. The cylinder member 21*a*, input inner gear 21*c*, and end plate 21*d* in the input part are adapted to rotate together on the support casing 25*a*.

In this stage, the differential motor 24 (oval plate 23*a*) is kept going at the same speed as that of said driving motor 20*a* (input outer gear, input inner gears 21*b*, 21*c*). The oval plate 23*a* of the differential portion 23, said input inner gear 21*c*, and the output outer gear 22*a* of the output portion, both gears being in a partial meshing relationship, may rotate all together and with the accompaniment of the output shaft 22*c* as well.

Then the pinion shaft 12 is driven to rotate at the same speed as that of the rotor 4 by the output driving gear 22*d* and the output driven gear 22*e* (both gears are the same as the input outer gear 21*b* in the number of tooth). At this time, the dies 8 rest out of action.

Next, if the differential motor 24 is accelerated (or decelerated), there occurs the speed difference between the differential motor 24 and the driving motor 20*a*. And between the oval plate 23*a* and the elastic cylinder member 22*b* of the output part 22, the relative change of position in the circumferential direction will be made by the elastic bearing 23*b* of the differential portion accordingly.

According to this amount of change, the difference of rotary speed due to the difference of the input inner gear 21*c* (the number of tooth=N1) and the output outer gear 22*a* (the number of tooth=N2) in the number of tooth (N1−N2=2 in the embodiment) takes place between the cylinder member 21*a* of the input portion and the output shaft 22*c*. This may cause the difference of the rotary speed between the rotor 4 and the pinion shaft 12, thereby putting the dies 8 into action.

The use of such a wave generator-typed differential gears 20 enable obtainment of great torque for a device of small size and light weight and of a quiet and highly efficient operation.

Said wave generator-typed differential gears 20 are a variation of the planetary gears, wherein the differential shaft 23*c*, the shaft of the oval plate 23*a* (wave generator), serves as a carrier shaft, the output outer gear 22*a*, the elastic gear, as a planet gear, and the input inner gear 21*c* as a sun gear respectively.

If there is a difference in the number of tooth between the elastic gear and the inner gear, single turning of the wave generator will cause relative displacement by the amount of difference in the number of tooth.

Instead of the wave generator-typed planetary gears are also applicable a general type of planetary gears consisting of two sun gears and planet gears and carrier.

The present invention is not limited to the aforementioned examples and embodiments, and may be varied without deviating from the spirits and scope of the claims.

INDUSTRIAL FIELD OF APPLICATION

The present invention can be used for the method and device for rotating and machining bar material.

What is claimed is:

1. A method for rotating and machining bar material which comprises:

holding a disc-shaped rotor rotatably around a horizontal axis, providing a pair of rails which are radially opposite to each other and have chord-shaped sliding surfaces in parallel with each other on a peripheral edge of a front end of said rotor, engaging tool holders slidably with each of said pair of rails, fixing a pair of tools securely by said tool holders, feeding a workpiece of bar material toward the center of rotation of the rotor, holding the workpiece securely between the tools, and rotating the rotor to displace the tools in directions opposite to each other along the rails.

2. A method for rotating and machining bar material according to claim 1 which comprises:

said tools being thread rolling flat die.

3. A device for rotating and machining bar material which comprises:

a disc-shaped rotor rotatably around a horizontal axis, a driving means for said rotor, a pair of rails which are radially opposite to each other and have chord-shaped sliding surfaces in parallel with each other on a peripheral edge of a front end of said rotor, a pair of tool holders slidably engaged with each of said pair of rails, and a pair of tools securely by said tool holders, then, the rotor is rotated, the tools arc displaced in h directions opposite to each other along the rails.

4. A device for rotating and machining bar material which comprises:

a disc-shaped rotor held rotatably around a horizontal axis, a driving means for said rotor, a pair of rails which are radially opposite to each other and have chord-shaped sliding surfaces in parallel with each other on a peripheral edge of a front end of said rotor, a pair of tool holders engaged slidably with each of said pair of rails, a pair of tools securely fixed by said tool holders, a pair of racks securely fixed on the back of said tool holders, a pinion in a meshing relationship with said pair of racks, a pinion shaft having said pinion fixed to the front end thereof and extending backwards through the center of rotation of said rotor with a space between them, and a driving means for said pinion shaft, then said tools are displaceable in opposite directions along said rails via said rack and said pinon by use of a difference of said rotor and pinion in rotary speed.

5. A device for rotating and machining bar material which comprises:

a disc-shaped rotor held rotatably around a horizontal axis, a pair of rails which are radially opposite to each other and have chord-shaped sliding surfaces in parallel with each other on a peripheral edge of a front end of said rotor, a pair of tool holders engaged slidably with each of said pair of rails, a pair of tools securely fixed by said tool holders, a pair of racks securely fixed on the back of said tool holders, a pinion in a meshing relationship with said pair of racks, a pinion shaft having said pinion fixed to the front end thereof and extending backwards through the center of rotation of said rotor with a space between them, and a planetary gear connected between said rotor and said pinion shaft then said tools are displaceable in opposite directions along said rails via said rack and said pinion by making use of a difference of said rotor and pinion in rotary speed.

6. A device for rotating and machining bar material which comprises:

a disc-shaped rotor held rotatably around a horizontal axis, a pair of rails which are radially opposite to each other and have chord-shaped sliding surfaces in parallel with each other on a peripheral edge of a front end of said rotor, a pair of tool holders engaged slidably with each of said pair of rails, a pair of tools securely fixed by said tool holders, a pair of racks securely fixed on the back of said tool holders, a pinion in a meshing relationship with said pair of racks, a pinion shaft having said pinion fixed to the front end thereof and extending backwards through the center of rotation of said rotor wit a space between them, and a planetary gear connected between said rotor and said pinion shaft, said planetary gear includes an input part, an output part and a differential part, the input part includes:

a cylinder member having a horizontal axis and an opening at one end thereof, an input outer gear on the outer periphery of the opening of the cylinder member, and an input inner gear on the inner periphery of the opening of the cylinder member, then the input outer gear is driven by a driving motor and bears meshing relationship with a driven gear secured to the rotor, the output part includes:

an elastic cylinder member having an opening at one end thereof, an elastic output outer gear which partially meshes with said input inner gear, an output shaft connected with the other end of the elastic cylinder member, and said output shaft is supported by a bearing concentrically on the other end of said cylinder member of the input part and juts forth therefrom, an output driving gear secured to the juts of the output shaft, and an output driven gear meshed with the output driving gear which is fixedly connected with said pinion shaft, the differential part includes:

a rigid oval plate positioned within the end portion of said elastic cylinder member of said output portion, an elastic bearing fitted with the outer peripheral face of the rigid oval plate, so that the elastic deformation of the cylinder member into an oval shape causes said output outer gear to engage partially with said input inner gear near the outer periphery of the oval, a differential shaft connected to the center of said oval plate, and a differential motor connected with the leading end of the differential shaft then said tools displaceable in opposite directions along said rails via said rack and said pinion by making use of a difference of said rotor and pinion in rotary speed.

7. A device for rotating and machining bar material according to claim 3 or 4 or 5 or 6 which comprises:

said tools being thread rolling flat die.

* * * * *